US007997410B2

(12) United States Patent
Ali et al.

(10) Patent No.: US 7,997,410 B2
(45) Date of Patent: Aug. 16, 2011

(54) DISK PACKAGE AND RETAINER

(75) Inventors: Terry Ali, Fairborn, OH (US); Christopher Ali, Beavercreek, OH (US); Frank F. Ali, Xenia, OH (US)

(73) Assignee: Ali Industries, Inc, Fairborn, OH (US)

( * ) Notice: Subject to any disclaimer, the term of this patent is extended or adjusted under 35 U.S.C. 154(b) by 0 days.

(21) Appl. No.: 12/431,319

(22) Filed: Apr. 28, 2009

(65) Prior Publication Data

US 2010/0270192 A1 Oct. 28, 2010

(51) Int. Cl.
*B65D 85/02* (2006.01)

(52) U.S. Cl. ..... 206/495; 206/303; 206/493

(58) Field of Classification Search ..... 206/495, 206/493, 445, 349, 372, 373, 308.1, 308.2, 206/303, 806

See application file for complete search history.

(56) References Cited

U.S. PATENT DOCUMENTS

| | | | | | |
|---|---|---|---|---|---|
| 483,991 | A * | 10/1892 | Chase | 206/349 |
| 1,137,126 | A * | 4/1915 | Fuller | 206/310 |
| 3,053,384 | A * | 9/1962 | Loomis | 206/372 |
| 3,053,424 | A * | 9/1962 | Reinhard | 294/163 |
| 3,393,798 | A * | 7/1968 | Beers | 206/372 |
| 4,122,945 | A * | 10/1978 | Borzak | 206/395 |
| D271,918 | S * | 12/1983 | Ramirez | D3/282 |
| 4,499,994 | A * | 2/1985 | Rentch | 206/310 |
| 4,650,074 | A * | 3/1987 | Vosbikian | 206/477 |
| 4,784,263 | A * | 11/1988 | Stanley | 206/349 |
| 4,790,430 | A * | 12/1988 | Thomas | 206/303 |
| 4,848,571 | A * | 7/1989 | Fullar | 206/372 |
| 4,883,178 | A * | 11/1989 | Thiele et al. | 206/391 |
| 5,363,962 | A * | 11/1994 | Toral et al. | 206/394 |
| 5,456,057 | A * | 10/1995 | Bannon et al. | 53/449 |
| 5,849,646 | A | 12/1998 | Stout et al. | |
| 6,112,894 | A * | 9/2000 | Kikuchi et al. | 206/308.1 |
| 6,161,689 | A * | 12/2000 | Reithel | 206/303 |
| 6,176,377 | B1 * | 1/2001 | Ali et al. | 211/41.1 |
| 6,427,832 | B1 | 8/2002 | Ali et al. | |
| 6,729,468 | B1 * | 5/2004 | Dobmeier | 206/303 |
| 2006/0000731 | A1 * | 1/2006 | Hayne et al. | 206/372 |

* cited by examiner

*Primary Examiner* — Steven A. Reynolds
(74) *Attorney, Agent, or Firm* — R. William Graham

(57) ABSTRACT

A disk package and retainer for a disk having an open surface therethrough and susceptible to curl includes a first member having a retention surface disposed adjacent a first side of the disk and adjacent the open surface of the disk and having a connecting surface and a second member having a retention surface disposed adjacent a second side of the disk and adjacent the open surface of the disk and having a connecting surface cooperatively connected to the connecting surface of the first member through the open surface such that the distance between the first member and second member can be adjustably maintained in a manner to apply force from opposite sides of the disk in a manner to substantially maintain the disk in a relatively flat condition. A panel is employed between the members adjacent the disk and method employing the members, disk and panel forms a package.

16 Claims, 2 Drawing Sheets

DISK PACKAGE AND RETAINER

BACKGROUND OF THE INVENTION

1. Field of Invention

This invention relates to packaging of a plurality of disks. More particularly, the invention relates to a fiber disk package and retainer and packaging method which offer improved shelf-life, stockability and curl prevention.

2. Related Art

One common form of abrasive article includes discs which are typically used for grinding. The disk is usually assembled with a rigid rotatably mountable support pad. These types of abrasive articles are typically made of paper, polymeric materials, cloth, nonwoven materials, vulcanized fiber, or combinations of these materials to perform a desired sanding operation.

While the vulcanized fiber disks are highly desired, these disks are very susceptible to age unacceptably rapidly. Vulcanized fiber backings are desirable because they are heat resistant and strong. Vulcanized fiber is used in grinding operations, such as weld grinding, contour grinding, and edge grinding. The main disadvantage of the vulcanized fiber disk is that it is relatively expensive, hygroscopic and sensitive to humidity. The disks are therefore difficult to maintain flat in humid conditions and under conditions of high and low humidity, vulcanized fiber will be affected by either expansion or shrinkage, due, respectively, to water absorption or loss. Consequently, the vulcanized disks will warp or curl with the abrasive coated side convex outward. Once curled, the disk does not lay flat against the support pad and when trying to flatten the disk they are subject to breaking as they are typically very brittle. This essentially renders the coated abrasive disc inoperable. This warping often occurs while on the shelf in the store or once opened from the package wherein one or more unused disks may be rendered to waste. This is a significant problem.

One thought at solving the problem was to add a number of holes in the disk to take out some of the stresses that build up in a sanding disk. This was thought lessen the curled state and render it more susceptible to straighten the disk. This however has produced less than a desirable result and has not significantly solved the curling issue. Another attempt was to provide a plastic clam shell package about the disks in an effort to prevent curling. However, this also has met with less than acceptable results.

Accordingly, there is a need to prevent curl in abrasive material. There is a need to provide a way to package and maintain abrasive materials in a way to prevent or minimize curl. The instant invention solves these needs.

SUMMARY OF THE INVENTION

The present invention solves the aforementioned and other problems of the prior art, and provides improved reusable package of for displaying articles, and is well suited for displaying abrasive disks and like articles having tendency to curl.

It is an object to prevent curling of abrasive material.

It is an object of the invention to provide a package wherein the article(s) being displayed and the indicia relating to the particular article are easily viewed.

It is still another object of the invention to provide a reusable package and retainer for abrasive article(s) tending to curl.

It is yet another object of the invention to provide a relatively efficient and inexpensive reusable package and retainer for displaying merchandise.

It is another object to increase shelf life of articles tending to curl.

Accordingly, one aspect of the instant invention is directed to disk package and retainer for a disk having an open surface therethrough. The package includes a first member having a retention surface disposed adjacent a first side of the disk and adjacent the open surface of the disk and having a connecting surface, a second member having a retention surface disposed adjacent a second side of the disk and adjacent the open surface of the disk and having a connecting surface cooperatively connected to the connecting surface of the first member through the open surface such that the distance between the first member and second member can be adjustably maintained in a manner to apply force from opposite sides of the disk in a manner to substantially maintain the disk in a relatively flat condition.

In an embodiment, the connecting surface of the first member can be a female threaded surface and the connecting surface of the second member is a male threaded surface. The retention surface of the first member can include a flange plate formed about the female threaded surface and the retention surface of the second member can include a flange plate formed about the male threaded surface. Further, each flange can include a protruding surface upon which to gain purchase grip for purposes of tightening and loosening the members.

A package panel can be provided having an open surface which can be generally co-axially aligned with the open surface of the disk. The first side of the disk can be further characterized to be a nonworking side and the second side can be a working side and the package panel can preferably be disposed adjacent a nonworking side of the disk. The package can further include a plurality of disks wherein at least two of the disks have nonworking surfaces disposed toward one another with working surfaces disposed away from one another.

A method of preventing curl in a disk having an open surface therethrough wherein the disk is susceptible to curl to cause a working surface to orient convexly includes the steps of providing a first member having a retention surface disposed adjacent a first side of the disk and adjacent the open surface of the disk and having a connecting surface, a second member having a retention surface disposed adjacent a second side of the disk and adjacent the open surface of the disk and having a connecting surface cooperatively connected to the connecting surface of the first member through the open surface such that the distance between the first member and second member can be adjustably maintained in a manner to apply force from opposite sides of the disk in a manner to substantially maintain the disk in a relatively flat condition; and adjustably connecting the members to apply the force to maintain the disk relatively flat. The method can further include providing a package panel between the first and second members, the package panel having an open surface and orienting the package panel adjacent a nonworking side of the disk and generally co-axially aligning the open surfaces of the disk and panel prior adjustably connecting the members. The method can further include providing plurality of the disks wherein the disks have nonworking surfaces disposed toward one another with working surfaces disposed away from one another and connecting the members about outermost disks.

These and other objects will be readily apparent from the following description when taken in conjunction with the accompanying drawings. It is an object

DETAILED DESCRIPTION OF THE PREFERRED EMBODIMENTS

Figure 1:
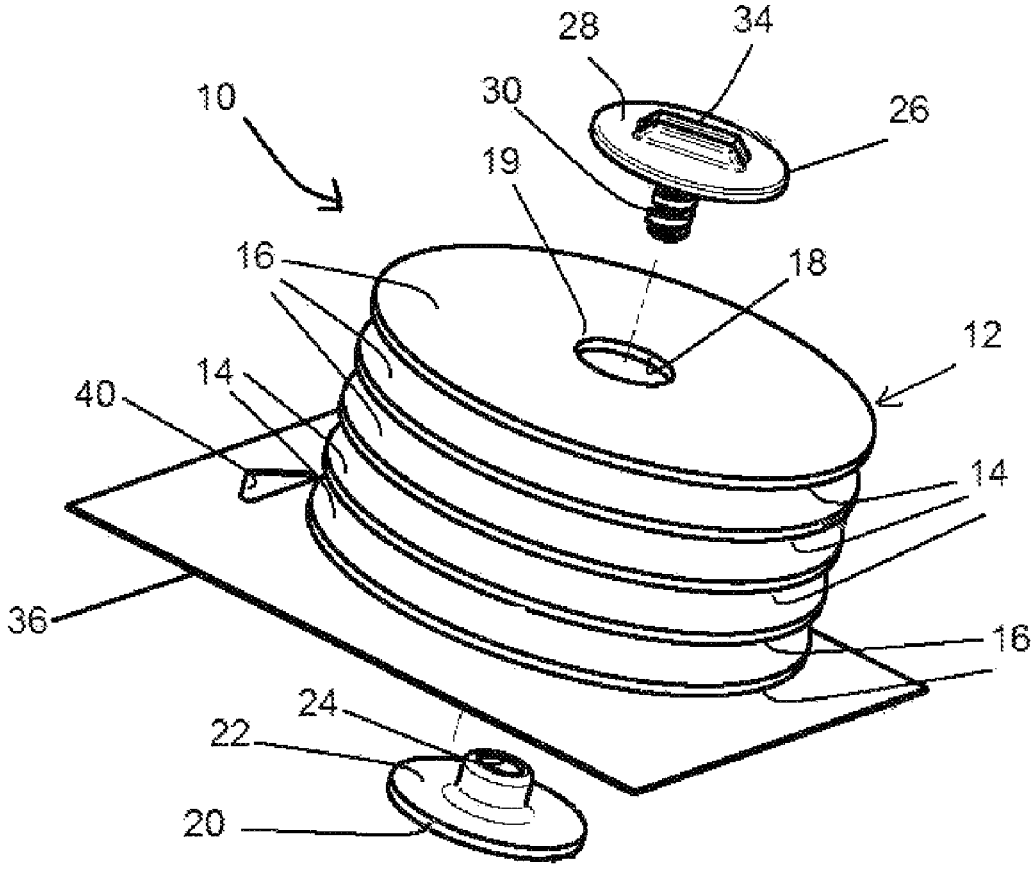
FIG. 1 is a perspective exploded view of the present invention.
Figure 2:
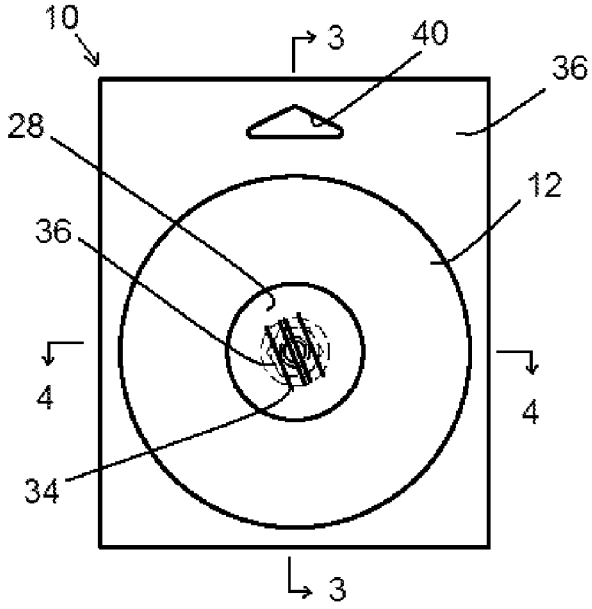
FIG. 2 is a front view of the present invention.

Referring now to the drawings, the disk package and retainer is generally designated by the numeral 10 and is generally for use for retaining and displaying one or more disks 12. In a preferred embodiment of the invention the disks 12 can be of the type which are vulcanized fiber abrasive and are thus highly susceptible to curl when exposed to humidity. A first side 14 of each disk 12 can be characterized to be a nonworking side and a second side 16 can be a working side which typically includes coated abrasive grit material. The disks 12 are made in variety of sizes and the instant invention is intended to be capable of being employed in a variety of applications. Each disk 12 has an open surface 18 which can preferably be centrally disposed therethrough.

A first retaining member 20 has a retention surface 22 disposed adjacent a first side of the disk 12 and adjacent the open surface 18 of the disk 12 and has a connecting surface 24. A second retaining member 26 has a retention surface 28 disposed adjacent a second side of the disk 12 and adjacent the open surface 18 of the disk 12 and has a connecting surface 30 cooperatively connected to the connecting surface 24 of the first retaining member 20 through the open surface 18 such that the distance between the first retaining member 20 and second retaining member 26 can be adjustably maintained in a manner to apply force from opposite sides of the disk 12 in a manner to substantially maintain the disk 12 in a relatively flat condition.

In an embodiment, the connecting surface 24 of the first retaining member 20 can be a female threaded surface which provides an opening entirely through the member 20. The connecting surface 30 of the second retaining member 26 can be a male threaded surface. The retention surface 22 of the first retaining member 20 can include a flange plate formed about the female threaded surface and the retention surface 28 of the second retaining member 26 can include a flange plate formed about the male threaded surface. The flange plates 22 and 28 can preferably be of a size to at least cover a portion of a surface 19 surrounding the open surface 18 and thus provide a generally equally distributed radial force on a central area of the disk 12.

Further, each flange 22 and 28 can include a protruding surface 32 and 34, respectively, upon which to gain purchase grip for purposes of tightening and loosening the members. Protruding surface 32 can be in the form of a hex head to be received in wrench and protruding surface 34 can be a raised surface having a slot to receive a flat head screw driver, for example. These protruding surfaces 32 and 34 can also be fashioned to permit manual threading and unthreading. While the embodiment is shown in an exemplary manner, it is conceived that there are other derivations and modifications of the invention which can be made in order to accomplish the same and the invention is intended to include the same.

A package panel 36 can preferably be provided as part of the invention. The panel 36 can preferably be of a size at least that of the diameter of the disk 12 and preferably larger. In this regard, the panel 16 can take on any suitable geometric configuration, and here is shown as rectangular and larger than disk 12 and has a similar open surface 38 which can be generally co-axially aligned with the open surface 18 of the disk 12. The panel 36 can include a triangular eyelet surface 40 which can be used to hang or store the package 10 using a pegboard or point of purchase stand or the like. The panel 36 can preferably be made of a relatively rigid material such as cardboard or the like with suitable printability. In the case where only a single disk 12 is on the package panel 36, the panel 36 can preferably be disposed adjacent a nonworking side of the disk 12. In this way since the curl tends to cause the working surface 16 to convex outward, the panel 36 in conjunction with the retaining members 20 and 26 can be used to prevent the curl.

Figure 3:
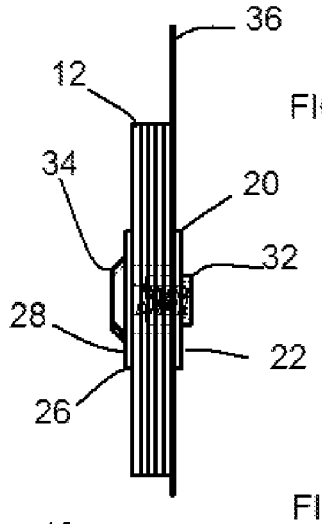
FIG. 3 is a side sectional view of FIG. 2 through line 3-3.
Figure 4:
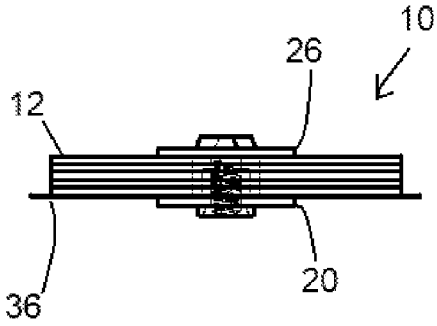
FIG. 4 is an end sectional view of FIG. 2 through line 4-4.
Figure 5:
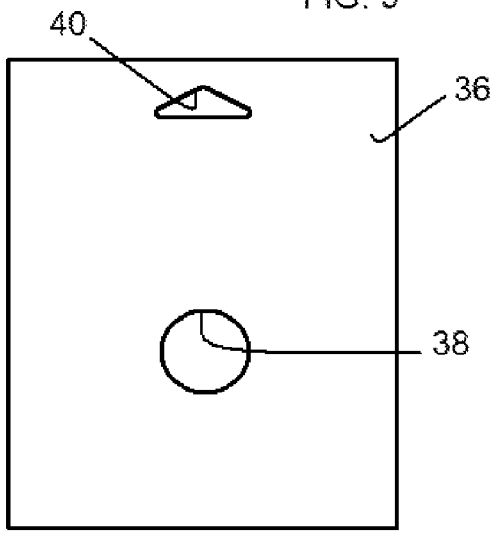
FIG. 5 is a plan view of a panel of the invention.

The package 10 can further include a plurality of disks 12. In such case, at least two of the disks 12 are disposed with nonworking surfaces 14 disposed toward one another with working surfaces 16 disposed away from one another. So for example, in the case of six disks 12, three disks 12 will have the nonworking surfaces 14 disposed toward the panel 36 with the remaining three disks 12 having working surfaces 16 disposed toward the panel 36. As seen in FIG. 3, for example, five disks 12 are part of package 10 wherein three disks 12 will have the nonworking surfaces 14 disposed toward the panel 36 with the remaining two disks 12 having working surfaces 16 disposed toward the panel 36. In this way, the natural forced which tend to cause curl of the disks 12 work to offset each other together with the retainer members 20 and 26 and panel 36 results in maintaining flat the disks 12.

A method of preventing curl in a fiber disk 12, such as a vulcanized fiber disk 12 is provided. These disks 12 are susceptible to curl to cause a working surface 16 to orient convexly. The method includes the steps of providing a first retainer member 20 having a retention surface 22 disposed adjacent a first side of the disk 12 and adjacent the open surface 18 of the disk 12 and having a connecting surface 24, a second retainer member 26 having a retention surface 28 disposed adjacent a second side of the disk 12 and adjacent the open surface 18 of the disk 12 and having a connecting surface 30 cooperatively connected to the connecting surface 24 of the first retainer member 20 through the open surface 18 such that the distance between the first retainer member 20 and second retainer member 26 can be adjustably maintained in a manner to apply force from opposite sides of the disk 12 in a manner to substantially maintain the disk in a relatively flat condition. The members 20 and 36 are adjustably connected to apply the force to maintain the disk 12 relatively flat. The method can further include providing a package panel 36 between the first and second members 20 and 26, the package panel 36 having an open surface 38 and orienting the package panel 36 adjacent a nonworking side 16 of the disk 12 and generally co-axially aligning the open surfaces 18 and 38 prior to adjustably connecting the members 20 and 26. In the instant example, the nonworking side 14 tends to be the side of the abrasive disk 12 which curls inwardly concave. The method can further include providing plurality of the disks 12 wherein the disks 12 have nonworking surfaces disposed toward one another with working surfaces disposed away from one another and connecting the members 20 and 26 about outermost disks.

The above described embodiments are set forth to exemplify the invention and are in no way meant to limit the present invention. It will be readily apparent to those skilled in the art that various modifications, derivations and variations can be made to material and to structure without despairing from scope or essence of the invention. Accordingly, the appended claims should be read in their full scope including any such modifications, derivations and variations.

What is claimed is:

1. A disk package and retainer for a disk having an open surface therethrough, which includes:

a plurality of fiber based disks, each said disk having an open surface therethrough and susceptible to curl and wherein said open surfaces of said disks are coaxially aligned to form a plurality of co-aligned open surfaces having a first axial length;

a first member having a laterally extending retention surface of a first radial length disposed adjacent a first side of one of said disks and adjacent said open surface of said one disk having a connecting surface generally normal to said laterally extending retention surface which is of a size and length to extend through said open surface a distance less than said first axial length and wherein said connecting surface of said first member includes a female threaded surface extending entirely through said first member;

a second member having a laterally extending retention surface of a radial length substantially that of said first radial length disposed adjacent another side of one of said disks and adjacent said open surface of said disk and having a connecting surface generally normal to said laterally extending retention surface which is of a size and length to extend from said another side through said open surface of said disk and cooperatively connect to said connecting surface of said first member through said open surface such that a distance between said first member and second member can be adjustably maintained in a manner to apply force from opposite sides of each said disk in a manner with generally equally distributed radial force on a central area of each said disk to substantially maintain each said disk in a relatively flat condition and wherein said connecting surface of said second member is a male threaded surface; and which includes a package panel having an open surface which can be generally co-axially aligned with said open surface of one or more of said disks and disposed adjacent one or more of said disks between said first and second members and wherein said panel is paper based with a printable surface.

2. A disk package and retainer of claim 1, wherein said disks are circular abrasive disks.

3. A disk package and retainer of claim 1, wherein said retention surface of said first member includes a flange formed about said female threaded surface and said retention surface of said second member includes a flange formed about said male threaded surface.

4. A disk package and retainer of claim 3, wherein each said flange includes a protruding surface upon which to grip for purposes of tightening and loosening said members.

5. A disk package and retainer of claim 1, wherein each said disk is further characterized to have a nonworking side and a working side and said package panel is disposed adjacent a nonworking side of said disk.

6. A disk package and retainer of claim 1, wherein at least two of said disks have nonworking surfaces disposed toward one another with working surfaces disposed away from one another.

7. A disk package and retainer of claim 1, wherein said panel is of a size and rigidity to counteract forces of curl of said disks.

8. A method of preventing curl in a disk having an open surface therethrough wherein said disk is susceptible to curl to cause a working surface to orient convexly, including the steps of:

(a) providing a plurality of fiber disks, each said fiber based disk having an open surface therethrough and susceptible to curl and wherein said open surfaces of said disks are coaxially aligned to form a plurality of co-aligned open surfaces having a first axial length;

(b) providing a first member having a laterally extending retention surface of a first radial length disposed adjacent a first side of one of said disks and adjacent said open surface of said disk having a connecting surface generally normal to said laterally extending retention surface which is of a size and length to extend through said open surface of a distance less than said first axial length and wherein said connecting surface of said first member includes a female threaded surface extending entirely through said first member, a second member having a laterally extending retention surface of a radial length substantially that of said first radial length disposed adjacent another side of one of said disks and adjacent said open surface of said disk having a connecting surface generally normal to said laterally extending retention surface which is of a size and length to extend from said another side through said open surface of said disk and wherein said connecting surface of said second member is a male threaded surface cooperatively connect to said connecting surface of said first member through said open surface such that a distance between said first member and second member can be adjustably maintained in a manner to apply force from opposite sides of each said disk in a manner with generally equally distributed radial force on a central area of each said disk to substantially maintain each said disk in a relatively flat condition;

(c) providing a paper based package panel with a printable surface between said first and second members, said package panel having an open surface and orienting said package panel adjacent a nonworking side of said one disk and generally co-axially aligning said open surfaces of said one or more disks and panel prior to adjustably connecting said members; and (d) adjustably connecting said first and second members to apply said force to maintain each said disk relatively flat.

9. The method of claim 8, wherein at least two of said disks have nonworking surfaces disposed toward one another with working surfaces disposed away from one another and connecting said first and second members about outermost disposed of said disks.

10. A disk package and retainer for a disk having an open surface therethrough, which includes:

a plurality of fiber based disks, each said disk having an open surface therethrough and susceptible to curl and wherein said open surfaces of said disks are coaxially aligned to form a plurality of co-aligned open surfaces having a first axial length;

a first member having a laterally extending flat flange retention surface of a first radial length disposed adjacent a first side of one of said disks and adjacent said open surface of said one disk having a connecting surface generally normal to said laterally extending retention surface which is of a size and length to extend through said open surface a distance less than said first axial length and wherein said connecting surface of said first member includes a female threaded surface extending entirely through said first member; and a second member having a laterally extending flat flange retention surface of a radial length substantially that of said first radial length disposed adjacent another side of one of said disks and adjacent said open surface of said disk and having a connecting surface generally normal to said laterally extending retention surface which is of a size and length to extend from said another side through said open surface of said disk and cooperatively connect to said connecting surface of said first member through said open surface such that a distance between said first member and second member can be adjustably maintained in a manner to apply force from opposite sides of each said disk in a manner with generally equally distributed radial force on a central area of each said disk to substantially maintain each said disk in a relatively flat condition and wherein said connecting surface of said second member is a male threaded surface.

11. A disk package and retainer of claim 10, which includes a package panel having an open surface which can be generally co-axially aligned with said open surface of said disks and disposed adjacent one of said disks between said first and second members and wherein said panel is paper based with a printable surface.

12. A disk package and retainer of claim 11, wherein each said disk is further characterized to have a nonworking side and a working side and said package panel is disposed adjacent a nonworking side of said disk.

13. A disk package and retainer of claim 11, wherein said panel is of a size and rigidity to counteract forces of curl of said disks.

14. A disk package and retainer of claim 10, wherein said disks are circular abrasive disks.

15. A disk package and retainer of claim 10, wherein each said flange includes a protruding surface upon which to grip for purposes of tightening and loosening said members.

16. A disk package and retainer of claim 10, wherein at least two of said disks have nonworking surfaces disposed toward one another with working surfaces disposed away from one another.

* * * * *